US005392585A

United States Patent [19]

Wall

[11] Patent Number: 5,392,585

[45] Date of Patent: Feb. 28, 1995

[54] ROLLED PAPER WRAPPING APPARATUS

[76] Inventor: Benjamin Wall, 19984 Woodlake Rd., Pierson, Mich. 49339

[21] Appl. No.: 1,179

[22] Filed: Jan. 6, 1993

[51] Int. Cl.[6] ..... B65B 11/04; B65B 25/24

[52] U.S. Cl. ..... 53/136.2; 53/204; 53/329.2; 219/539

[58] Field of Search ..... 53/136.2, 478, 329.2, 53/214, 204; 219/537, 539, 447, 463

[56] References Cited

U.S. PATENT DOCUMENTS

| | | | |
|---|---|---|---|
| 1,669,005 | 5/1928 | Hustadt et al. | 219/539 X |
| 2,448,478 | 8/1948 | White | 53/136.2 X |
| 2,674,074 | 4/1954 | Lancaster et al. | 53/136.2 |
| 2,762,896 | 9/1956 | Pendleton | 219/539 |
| 4,368,380 | 1/1983 | Igashira et al. | 219/539 |
| 4,820,374 | 4/1989 | Lamb | 53/136.2 X |

*Primary Examiner*—James F. Coan

*Attorney, Agent, or Firm*—Waters & Morse

[57] ABSTRACT

A header heat plate for a large paper roll wrapping machine comprising a plurality of separate face plate sections that are mounted on a common backing plate to form a complete header plate for applying a roll header to an end of a paper roll. A roll header is temporarily held to the face plate sections through the application of a vacuum suction to openings in the face plate sections. Each face plate section includes heating elements integrally molded therein. These are heated to activate a heat sensitive adhesive contained on the roll side of the roll header. A wrapping paper is applied to the roll and crimped over interior roll headers inserted at the ends of the rolls. Grooves are cut along the side edges of the wrapping paper to reduce the amount of wrapping paper overlap and indentations in the ends of the paper rolls caused thereby.

8 Claims, 5 Drawing Sheets

ROLLED PAPER WRAPPING APPARATUS

BACKGROUND OF THE INVENTION

This invention relates to roll paper wrapping apparatus and more particularly roll header heat plates which may be assembled from multiple interchangeable sections and to protective wrapping for newsprint and fine paper rolls having a series of grooves in side edges that eliminate the formation of indentations in the ends of the paper rolls due to ridges in overlapping end wrap paper.

Newsprint and other forms of paper are manufactured and processed as large elongated sheets or webs. For storage and transport, the paper stock is wrapped around a core plug to form a cylindrical roll. The rolls are very heavy. A typical roll may range from 25 to 72 inches in diameter. To protect the roll from moisture, the atmosphere, and physical abrasions, the roll itself is wrapped in a moisture proof protective wrapping. Typically the rolls are then stacked one on the other and stored on end. Specialized machinery must be employed to automatically apply wrapping paper to the large rolls.

Various methods previously have been used to wrap paper rolls. One of the most successful methods has been to first wrap the roll in one or two layers of a protective wrapping paper, with the wrapping paper extending outwardly beyond the ends of the roll. Next, interior roll headers (disks formed of corrugated cardboard, chipboard, or laminated kraft paper) are fitted inside the wrapping paper against the ends of the roll. The wrapping paper is then crimped over the edges of the interior headers at the ends of the rolls using a crimping wheel. A set of exterior or outside roll headers (somewhat thinner disks typically formed of a kraft paper with a poly coating on the inside surface) are then attached to the ends of the roll over the crimped edges. The headers and the wrapping paper are held in place and affixed to one another through the use of a heat sensitive adhesive (the poly coating) on the inside surface of the outside roll header.

To affix the outside roll headers to the ends of the rolls in a typical roll wrapping machine, a roll is placed longitudinally between a pair of header heat plates. Each header heat plate is provided with a plurality of vacuum holes, which are used to temporarily secure a roll header to the header plate. A plurality of heating elements attached to the header heat plate heat the plate itself. The heat plate activates the heat sensitive adhesive on the inside surface of the outside roll header and simultaneously presses the outside roll header against the crimped wrapping paper and inside roll header on the end of the roll. The header heat plate is then disengaged from the roll header, leaving the two headers and wrapping paper firmly attached to the end of roll.

A typical heat plate is an assembly of several components. A one piece aluminum face plate one and one-half inch thick contacts the roll headers. Separate elongated heating elements (there may be thirty-six or so strip heaters) are mounted on the rear side of the face plate in order to heat to the face plate. The strip heaters are spaced apart and arranged to provide a uniform distribution of heat while not interfering with the vacuum holes in the face plate. Each heater element is individually bolted to the face plate and electrically routed to a power source. Spacer plates in the form of cross bars fit between the strip heaters, and an element back plate is mounted over the spacer plates. A layer of insulation board is mounted over the element back plate, and a header back plate is mounted over the insulation. The whole assembly is held together by bolts that extend through the plates.

The aforementioned system has several disadvantages. Each header plate is very large, heavy, complicated, and expensive. Due to the heat and pressure and physical conditions involved with affixing roll headers to a roll, the header plate is readily susceptible to damage. Replacement of an entire header plate is cumbersome, time-consuming, and expensive. Additionally, the replacement header plate must be manually fitted with the heating elements before it can be used. This is labor intensive and expensive.

It is an object of the present invention to provide a header heat plate which may be easily assembled and is less cumbersome and expensive to replace. It is also an object of the invention to provide a header heat plate wherein a damaged portion of the header heat plate can be replaced without necessitating replacement of the entire unit and without requiring that a complete replacement header heat plate be maintained in inventory. It is another object of the invention to provide a header heat plate in which the heating elements are cast within the plate rather than manually fitted to the rear of the plate. It is still another object of the invention to accomplish the above objectives while still interfacing with conventional equipment in the industry.

The wrapping paper also forms an integral part in the protection of the roll. This wrapping paper is rolled around the roll after the interior roll headers have been affixed. The side edges of the wrapping paper usually extend six inches beyond the side edges of the roll. After the wrapping paper has been applied to the roll, the protruding edge is then crimped over the end. As the edges are crimped over, part of the wrapping paper overlaps onto itself forming raised areas or ridges in the wrapper (FIG. 7). Due to the extreme weight involved in storing these heavy paper rolls in stacks on their ends, the ridges are permanently indented into the soft paper ends of the rolls. These indentations are very disadvantageous and cause the paper to tear when unrolled. Additionally, as a result of the ridges, a distorted edge can be produced in the final paper product.

It is another objective of the present invention to provide a wrapping paper that will not produce ridges in the crimped ends of the wrapping paper when the rolls are stacked on their ends.

SUMMARY OF THE INVENTION

The present invention comprises a header heat plate for a roll paper wrapping apparatus wherein a circular roll header coated with a heat sensitive adhesive is affixed to each end of a roll of paper by pressing the roll header against the end of the roll with a header heat plate. In the present invention, the header heat plate is formed in a plurality of header face plate sections, which are connected together edge to edge on a backing plate, the sections being individually changeable such that the entire header heat plate need not be replaced when one section becomes damaged or wears out. Preferably the face plate is formed in four equal sized ninety degree arcuate sections.

Another feature of the present invention is that heating elements are integrally molded into each header face plate section. This eliminates the need to individually bolt each heating element on each face plate section when the face plate sections are assembled or changed.

The header heat plate of the present invention preferably has a core recess therein that accommodates a roll core or core plug that extends beyond the end of the paper in the roll, such that the header plate can be pressed against the paper while the core or core plug extends into the core recess in the header plate, the core recess being elongated in a vertical direction so as to accommodate the cores of paper rolls of different diameters.

An improved wrapping paper employed in the roll paper wrapping apparatus of the present invention comprises inwardly extending cut-out portions (preferably V or U-shaped) formed along side edges thereof, such that when the side edges of the wrapping paper are crimped over the ends of the roll, the wrapping paper does not fold over on itself so as to form ridges on the ends of the rolls, whereby the formation of ridge-induced indentations in the ends of the paper roll is restricted.

These and other features and advantages of the present invention are described in more detail below and shown in the appended drawings.

DETAILED DESCRIPTION OF THE PREFERRED EMBODIMENT

Figure 1:
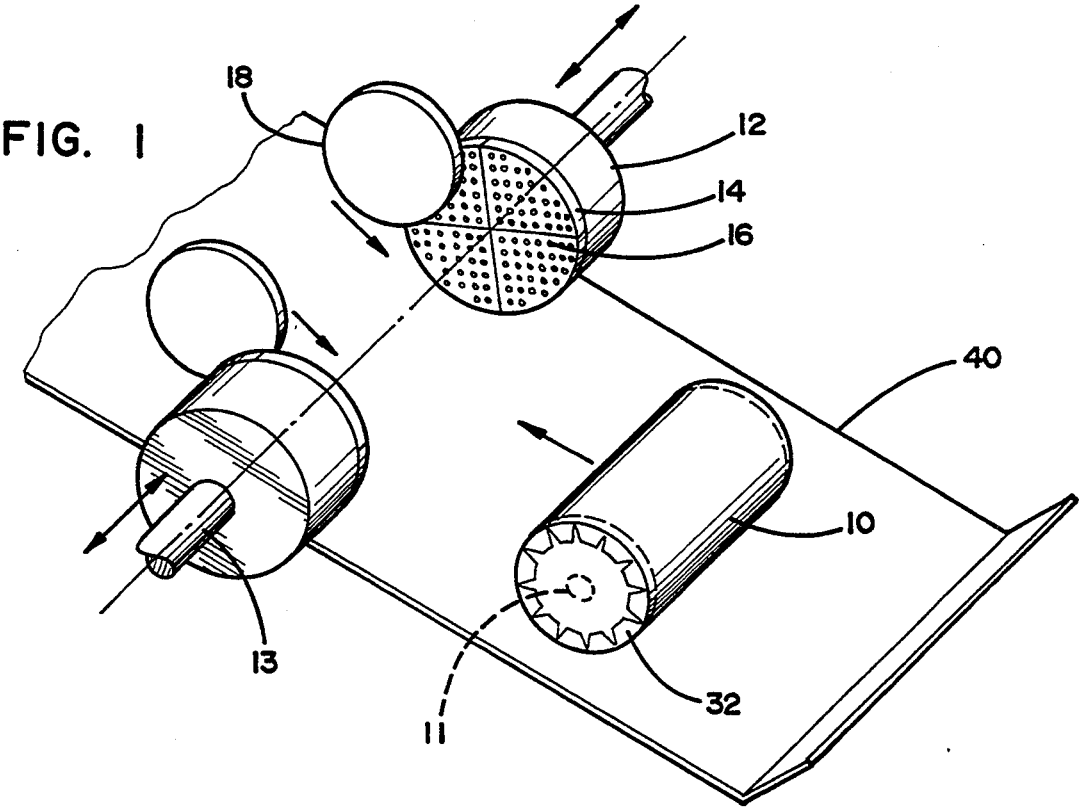
FIG. 1 is a perspective view of a header mounting apparatus showing the positioning of the headers on the header heat plates and the positioning of the paper roll.

Referring to the drawings and more particularly to FIG. 1, a header mounting apparatus is shown to allow a fuller description of the header heat plates. Arrows indicate the respective movements of the elements. A roll of paper 10 (already wrapped with wrapping paper and having the wrapping paper crimped over an interior roll header) is supported by a paper roll support 40. After the roll 10 has been properly positioned, as indicated by the arrows, header heat plates 14 mounted on movable header plate mounts 12 are used to affix outside roll headers 18 to the respective ends of roll 10. The header plate mounts 12 move laterally with respect to the roll 10 and press the outside roll headers 18 on the respective ends of roll 10. Header heat plates 14 are affixed to the interior ends of the header plate mounts 12 to contact the headers.

Vacuum holes 16 are provided in each of the header heat plates 14 and extend into a saucer shaped vacuum chamber 28 on the interior end of each of the header plate mounts. A suction is created within the vacuum chamber which is used to temporarily hold the roll header 18 to the header heat plate 14. Each roll header 18 is coated on one side with a heat sensitive adhesive such as polyethylene, which bonds the roll headers to the roll 10. Roll 10 may be any of a number of types of rolled paper including lightweight wrapping paper and newsprint. The paper is rolled around a core plug 11. Heat supplied from each header heat plate 14 activates the heat sensitive adhesive on the roll header 18 and combined with pressure applied to the header from the header plate mount 12, bonds the roll header to a respective end of the roll. After the roll headers have been pressed onto the ends of the roll, the header plate mounts 12 are pulled laterally away from the roll 10 to allow removal of the roll therefrom.

Figure 2:
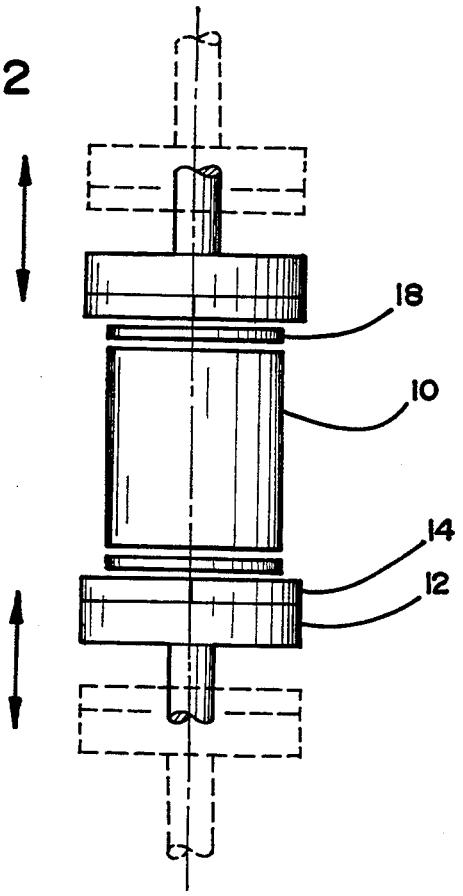
FIG. 2 is a top view of the header mounting apparatus showing the roll being sandwiched between two headers and their respective header heat plates.

FIG. 2 shows the placement of the roll 10 while the roll headers 18 are being applied. Arrows indicate the respective movement of the header plate mounts 12. The header plate mounts 12 may apply roll headers to rolls of varying size which are less in diameter than the header plates 14.

Figure 3:
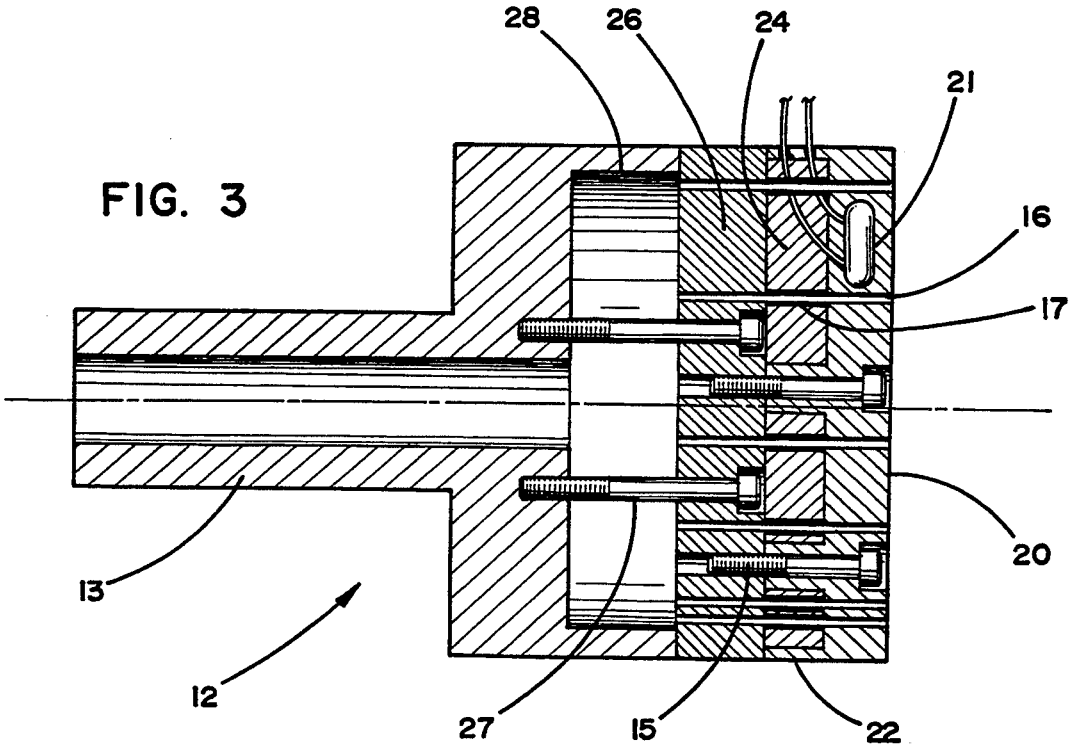
FIG. 3 is a side cross sectional view of the header heat plate mounted on a header plate mount.

FIG. 3 shows a cross-sectional view of the header plate mount 12 and a cross-sectional view of the header plate 14. The relative thickness of header plate 14 has been exaggerated to facilitate a detailed understanding of the invention. Header plate 14 is a combination of substantially three elements: face plate 20, insulation 24, and back plate 26. Face plate 20 makes contact with the roll header 18. Face plate 20 is a circular disk formed as an assembly of four pie shaped sections 20, each forming a 90 degree quadrant of a circle. Each section is a one and one-half inch thick cast aluminum plate having a one-quarter inch lip 22 extending rearwardly from the periphery of the face plate. While face plate 20 could be made from any number or shape of sections, four equal sized pie shaped elements provide the best combination of economy of manufacture and efficiency of assembly. The four pie shaped sections are bolted by bolts 15 to circular back plate 26 for support. Back plate 26 is a one-quarter inch thick disk of steel and is bolted by bolts 27 to the vacuum chamber of header mount 12.

Integrally molded in each face plate section 20' are electrical elements 21 (FIG. 6) which heat the face plate section 20'. Insulation 24 is disposed next to face plate section 20' to retain the heat in the face plate and limit heat transfer to the back plate. Back plate 26 is then secured next to insulation 24 to provide a mounting support for the entire face plate 20. Back plate 26 is one-quarter inch thick and made from steel. The one-quarter inch ridge 22 extending around the edge of each face plate section 20' acts as a spacer and provides a pocket for the insulation between the face plate and back plate.

Vacuum holes 16 run completely through the face plate 20, insulation 24, and back plate 26. The hole through insulation 24 is made larger and a sleeve 17 is inserted therein. The sleeve 17 prevents the insulation from being sucked into the vacuum chamber 28. Likewise, a bolt hole runs through all three elements with the hole in the backing plate being threaded. A boss 25 surrounding the bolt hole extends through insulation 24 and bears against the backing plate, thus serving as a spacer between the face plate and back plate.

The header plate mount 12 on which the header heat plate is mounted is conventional and includes a vacuum chamber 28 attached to the front end of a movable support assembly 13 (shown schematically). The support assembly includes a means for pressing the header heat plate mount 12 against roll header 18 and roll 10. Such a pressing means may be an hydraulically or air operated press which is well known in the industry.

Figure 4:
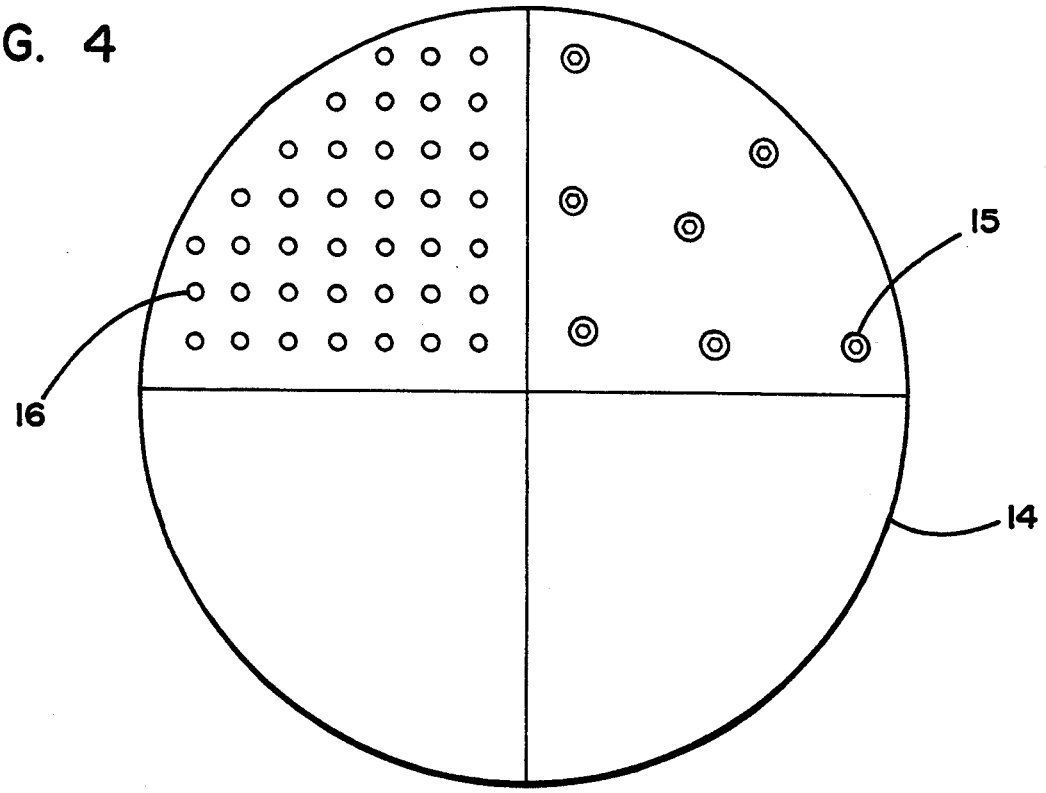
FIG. 4 is a schematic view of a multisectional header plate showing a representative placement of vacuum holes in the upper left quadrant and a representative placement of bolt holes in the upper right quadrant.

FIG. 4 shows a schematic view of a multisectional header heat plate 20 in accordance with the present invention. Vacuum holes 16 are representatively shown in the upper left quadrant. While the diameter of a header heat plate may change, the number of vacuum holes 16 per unit of area remains constant. Various configurations of vacuum holes are possible, but the most practical configuration is an array. To determine an appropriate array, a grid of squares, three inches per side is laid across a representative quadrant. At every corner of a square, a vacuum hole 16 is placed.

Referring to the upper right quadrant of the multisectional header heat plate in FIG. 4, representative placement of the face plate bolts 15 is disclosed. A bolt should be placed a radius of three inches from the center of the header heat plate and forty-five degrees inward from either edge. A second bolt should be placed directly in the center of the quadrant. The remaining five bolts should be evenly distributed around the outer edges of the section at a distance of one and one-half inches from the respective edges. The placement of the vacuum holes 16 in the upper left quadrant and face plate bolts 15 in the upper right quadrant are representative in nature. In actuality, the vacuum holes 16 and face plate bolts 15 coexist in all quadrants, which are identical.

Figure 5:
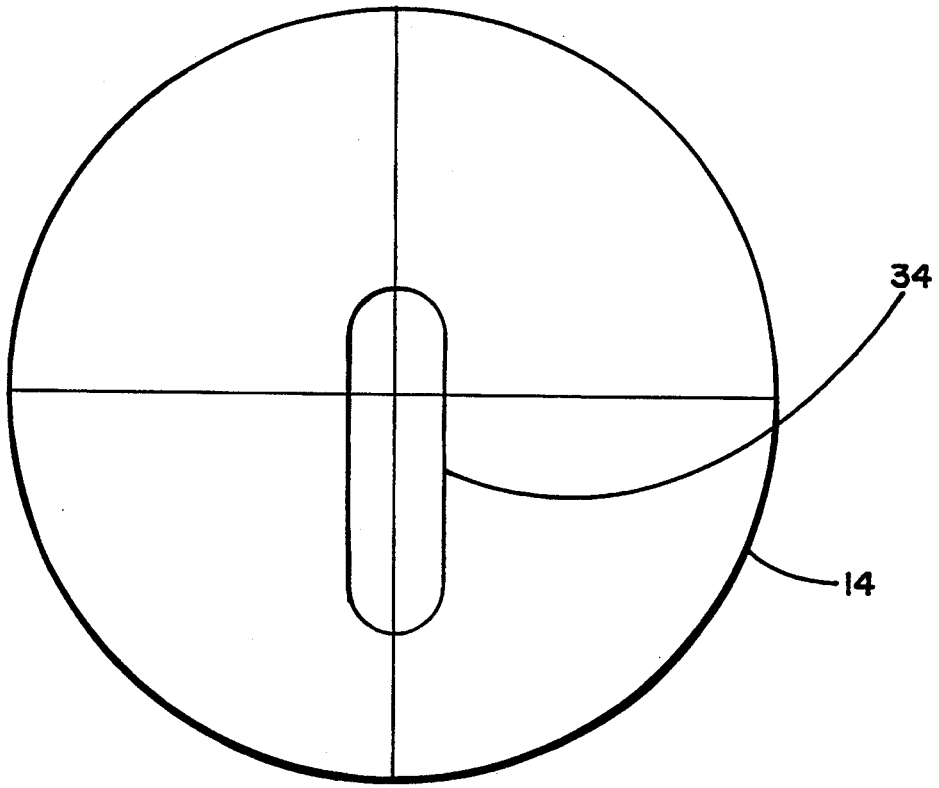
FIG. 5 is a schematic view of a multisectional header plate showing the placement of a core plug relief.

FIG. 5 shows the placement of core plug relief in an alternative embodiment of the present invention. In this embodiment, a cavity is milled into the face plate 20. This cavity is required in applications where the core plug 11 (FIG. 1) protrudes from a roll as a result of the manufacturing process. This core plug relief 34 accommodates a variety of rolls with differing diameters. Each quadrant of this embodiment requires a differently shaped cavity to create the core plug relief.

Although the diameter of the header plate may change, the relative measurements of the core plug relief 34 do not. The core plug relief is six inches wide and extends three inches above the center point of the header heat plate 14. The bottom of the core plug relief 34 is eight inches above the bottom of header heat plate 14.

Figure 6:
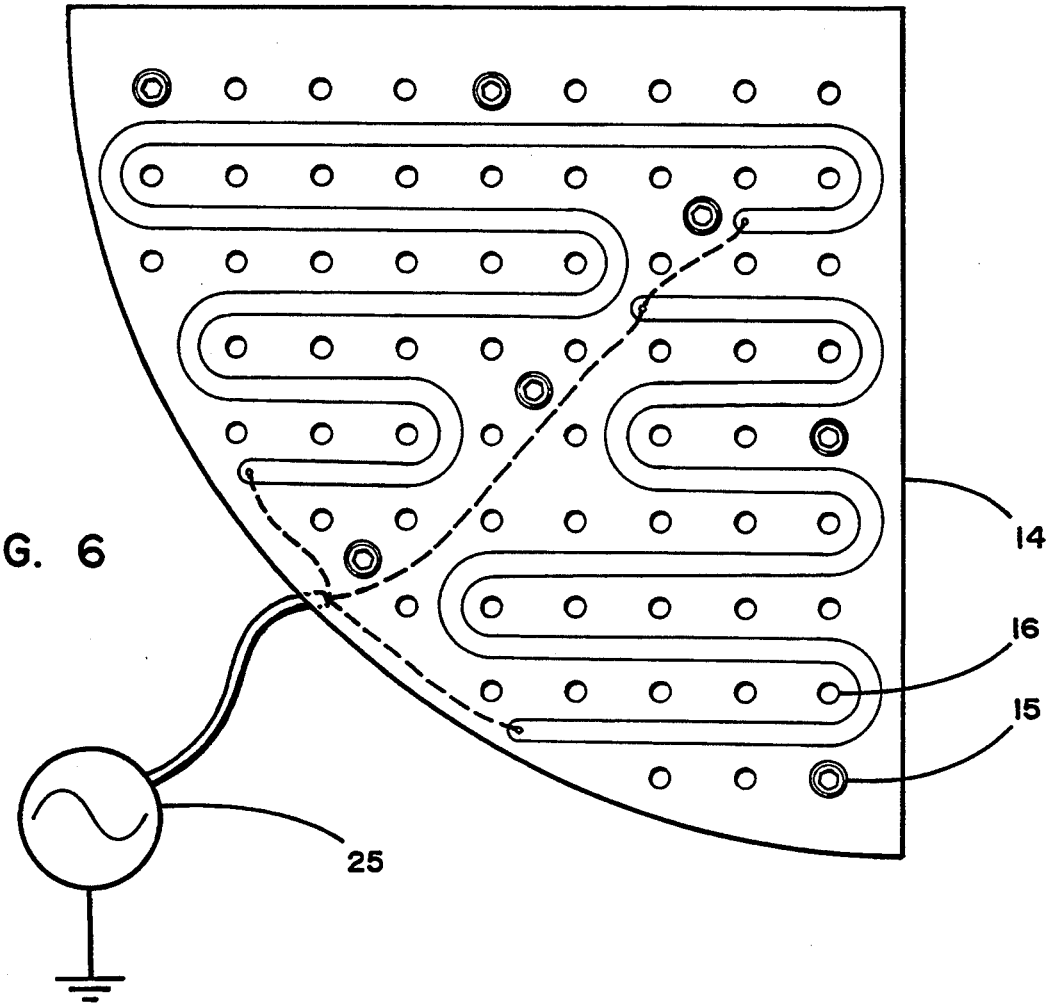
FIG. 6 is a schematic view of a header plate quadrant showing vacuum holes, bolt holes, and the placement of the electrical connection.

FIG. 6 is a schematic view of a header plate quadrant. Vacuum holes 16 and face plate bolts 15 are shown coexisting in the same header heat plate. The electrical leads for the heating elements exit from the back of the face plate and then can be routed from the header heat plate from the outer edge of the heat plate. The heating element leads also can be routed rearwardly away from the back center of the face plate. The heating elements are cast into the header plate quadrant. The heating elements are commercially available heaters called tubular component heaters. These are one-fifth to three-quarters of an inch in diameter and may be of various lengths. The tubular heating elements are bendable so they can be bent around vacuum holes 16 and face plate bolts 15 during the casting process. Such rod shaped heating elements are available from Chromalux. Such a placement of the heating elements provides a power distribution of ten to twelve watts per square inch to the face plate 20. The power supplied to the heating elements and could be any voltage, usually three phase voltage of 240 or 480 volts in the United States and 575 volts in Canada. Accordingly, different heating elements from Chromalux are used for the differing voltage levels.

Figure 7:
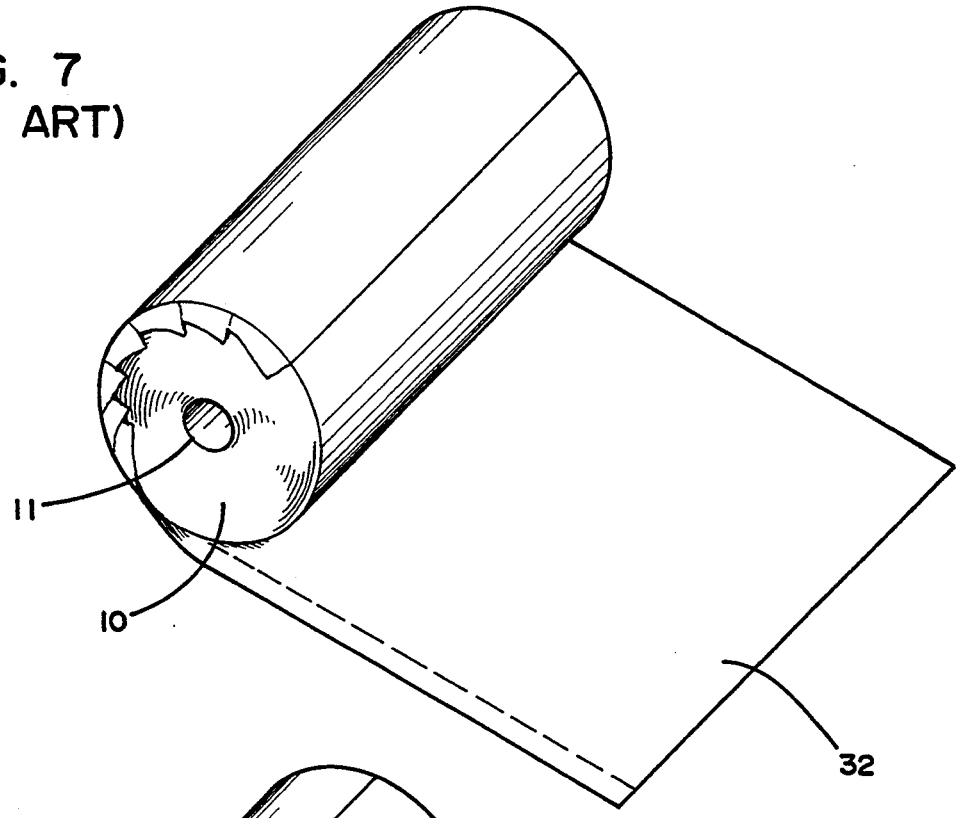
FIG. 7 (PRIOR ART)
FIG. 7 (prior art) is a perspective view of a roll being wrapped by a conventional wrapping paper.

FIG. 7 (prior art) shows a roll 10 wrapped by a conventional wrapping paper 32. Wrapping paper 32 extends six inches beyond the edges of roll 10. A crimping wheel crimps the edge over the interior roll header on the end of roll 10. However, the edge of wrapping paper 32 overlaps onto itself on the end of the roll during the crimping procedure. The crimping procedure involves a crimped wheel which hammers the edge onto the end of the roll 10. When wrapping paper 32 is crimped on the end of the roll, a ridge is produced. This ridge produces an indentation when it is hammered into the end of the roll 10. The ridges also indent into the end of roll 10 during the storage and transportation of the roll. Rolls are traditionally stacked one on top of the other on their ends in a warehouse facility. The weight of two or three rolls significantly increases the effect that the ridges have on the roll ends. Due to the severity of the ridge, and the consequential indentation, the paper from roll 10 becomes distorted and has a tendency to tear upon removal from the roll.

Figure 8:
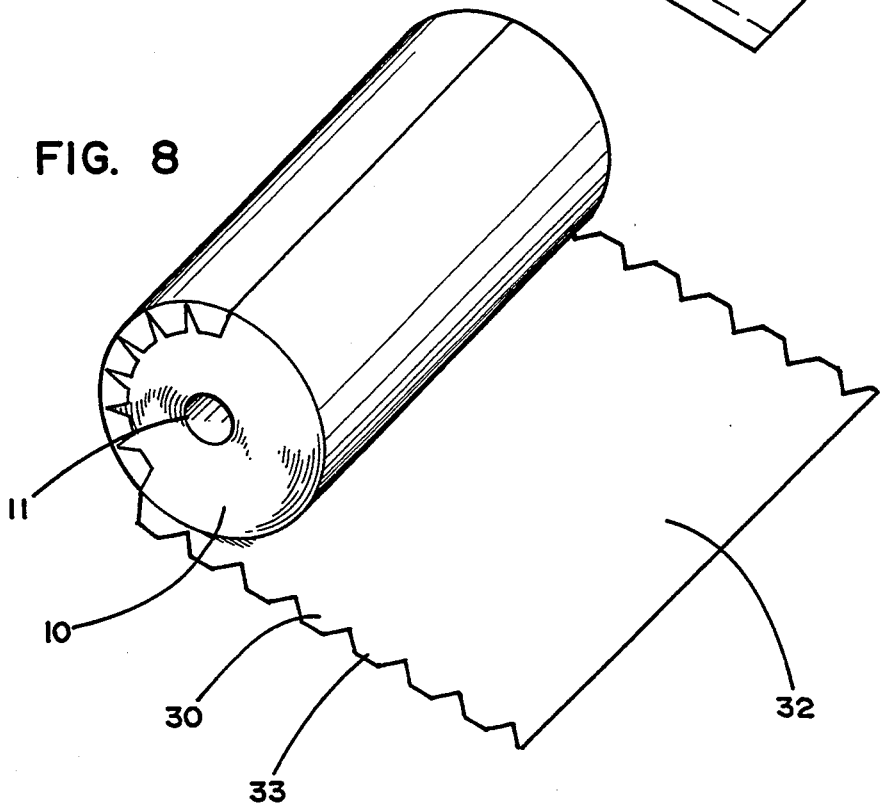
FIG. 8 is a perspective view of a standard roll being wrapped by a wrapping paper with V-shaped grooves according to the present invention.

FIG. 8 shows a roll 10 wrapped by a wrapping paper 32 in accordance with the present invention. The roll 10 should be wrapped one and one-half to two and one-half times by the wrapping paper 32 depending upon the physical properties of the wrapping paper. Any conventional wrapping paper may be used with the present invention including: most laminated papers, virgin kraft paper, poly-coated paper, recycled paper or wax laminate. V-shaped grooves 30 are cut into the edge of wrapping paper 32 and thereby form trapezoidal crimp edge 33. The depth of the V-shaped grooves varies depending upon the characteristics of the paper. However, the varying cuts may be made by the same V-shaped die by simply moving the die toward the outer edge of the wrapping paper during the cutting process.

In the configuration of FIG. 8, the six inch overlap is retained. However, V-shaped grooves 30 are cut along the sides of wrapping paper 32 to reduce the severity of the indentation produced by the ridge from the wrapping overlap. The V-shaped groove does not cut into the entire six inch overlap. The groove extends over a shorter portion than the six inch overlap to provide sufficient edge protection and a sufficient moisture barrier. For standard wrapping paper the tip of the V is five inches from the edge line of wrapping paper 32. Accordingly, the placement of the V-shaped grooves substantially reduces the severity of any indentation into the edge of roll 10 while still providing sufficient protection to the roll.

Figure 9:
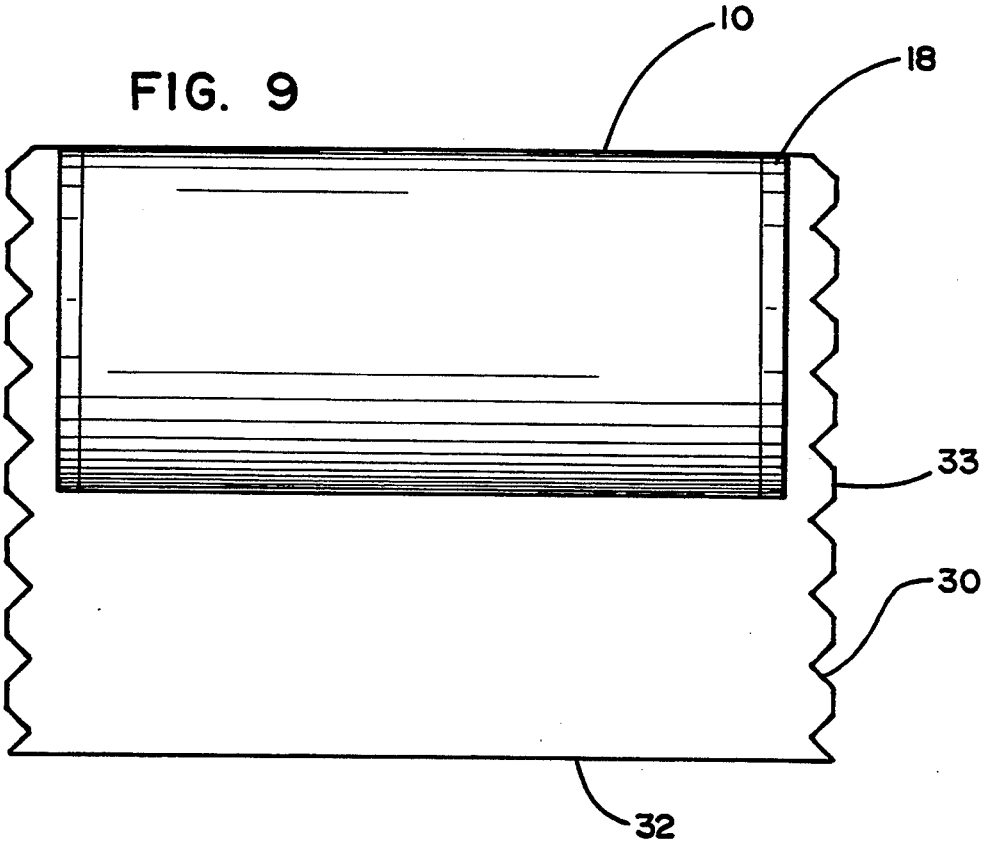
FIG. 9 is a top view of a roll with interior roll headers being wrapped by a wrapping paper with substantially V-shaped grooves according to the present invention.

FIG. 9 shows a top view of roll 10 with interior roll headers 19 shown where they are to be inserted after the roll is wrapped with paper 32 in accordance with the present invention. V-shaped grooves are provided in the sides of wrapping paper 32. Likewise, in FIG. 10, U-shaped grooves are proved in the sides of wrapping paper 32 in accordance with the present invention. The U-shaped grooves 31 extend five inches in from the side of the edge for standard wrapping paper. The U-shaped grooves form a semitrapezoidal crimp edge 36. The depth of U-shaped grooves 31 which are cut into the wrapping paper 32, vary depending upon the characteristics of the paper. However, the varying cuts may be made by the same U-shaped die by simply moving the die toward the outer edge of the wrapping paper during the cutting process.

Figure 10:
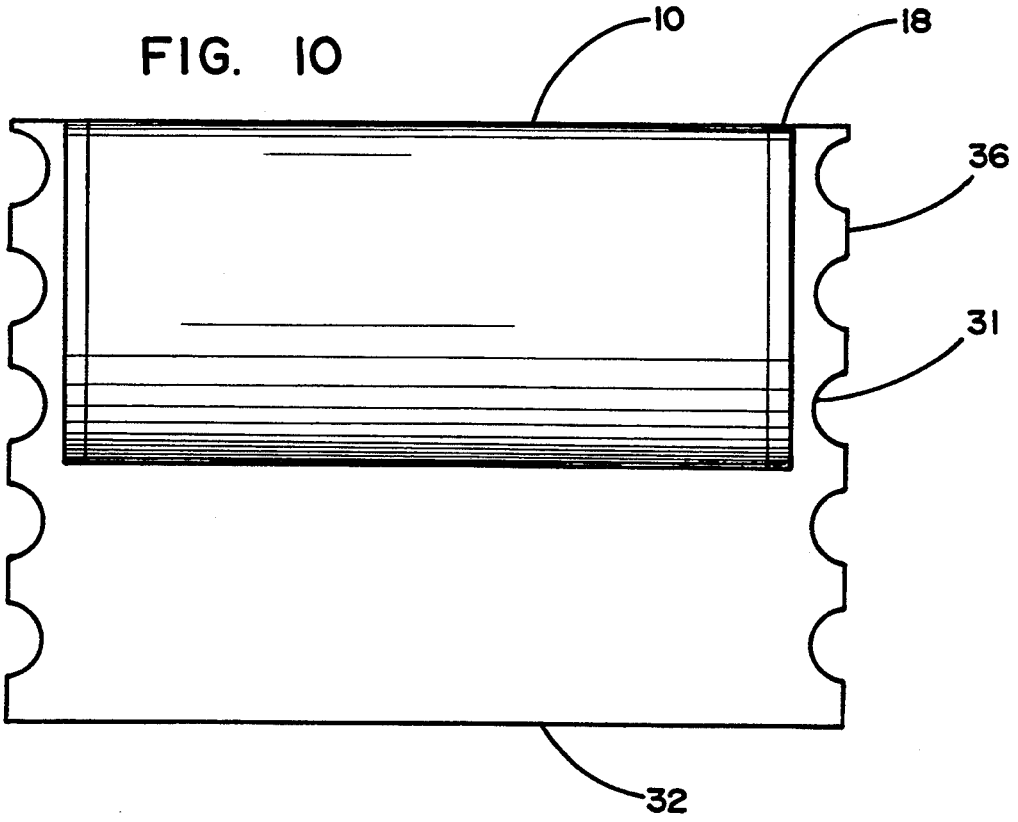
FIG. 10 is a top view of a roll with interior roll headers being wrapped by a wrapping paper with substantially U-shaped grooves according to the present invention.

By utilizing the grooves as shown in FIG. 9 and FIG. 10, the V-shaped grooves and the U-shaped grooves do not cut into the entire six inch overlap. Thus, both configurations provide sufficient edge protection over the interior roll header and a sufficient moisture barrier to the roll.

It should be understood that the foregoing is merely exemplary of the preferred practice of the present invention and that various changes may be made in the arrangements and details of construction of the embodiments disclosed herein without departing from the spirit and scope of the present invention, which is defined in the appended claims.

I claim:

1. A header heat plate for a roll paper wrapping apparatus wherein a circular roll header is affixed to each end of a roll of paper by pressing the header against the end of the roll with a header plate, the improvement wherein the header heat plate is circular and is formed in a plurality of interchangeable arcuate header face plate sections mounted together edge to edge on a backing plate, the sections being individually changeable such that the entire header heat plate need not be replaced when one section becomes damaged or wears out and a single replacement arcuate section can be used to replace a plurality of sections of the header face plate.

2. A header heat plate according to claim 1 wherein the roll header is affixed to the roll by a heat sensitive adhesive and each header face plate section includes interior heating elements, the heating elements in the header face plate sections being heated by a power supply to a sufficient temperature to activate the thermal adhesive.

3. A header heat plate for a paper roll wrapping machine comprising:

a plurality of face plate sections that fit together to form a complete face plate, the face plate sections comprising four nearly identically shaped face plate quadrants, the face plate quadrants being individually attached to and supported by a single back plate;

retaining means for temporarily holding a roll header to the face plate sections through the application of a vacuum suction through openings in the face plate sections; and heating means for heating each face plate section by providing an electric current to the heating means.

4. A header heat plate for a roll paper wrapping apparatus wherein a circular roll header having a heat sensitive adhesive thereon is affixed to each end of a roll of paper by pressing the header against the end of the roll with a heated header plate, the improvement wherein the header heat plate is formed in a plurality of header face plate sections mounted together edge to edge on a backing plate, the sections being individually changeable such that the entire header heat plate need not be replaced when one section becomes damaged or wears out, each header face plate section including interior heating elements, the heating elements in the header face plate sections being heated by a power supply to a sufficient temperature to activate the thermal adhesive, each header face plate section being molded out of metal and the interior heating elements being integrally molded therein, the heating elements having an externally accessible terminal that is connectable to the power supply to heat the section.

5. A header heat plate according to claim 4 wherein each face plate section includes vacuum openings therethrough and the apparatus includes vacuum means for drawing a vacuum through the openings such that roll headers are held to the header plate by vacuum prior to being pressed on the ends of the paper rolls.

6. A header heat plate for mounting a roll header on the end of a paper roll comprising:

a face plate having a generally planar front face, said face plate being formed from a plurality of generally identically shaped sections, each section having a plurality of vacuum holes therethrough and further including a plurality of electrically resistive heating elements cast within the header plate section, the heating elements having electrical leads extending to the exterior of the header plate section;

a back plate having a front face connected to and supporting each of the identical sections;

an insulation barrier mounted to a rear face of each heat plate section between the face plate and the back plate so as to contain the heat produced by the electrically resistive heating elements within the face plate; and means for mounting the header heat plate to a header plate mount of a paper roll wrapping machine.

7. A header heat plate for a roll paper wrapping apparatus wherein a circular roll header is affixed to each end of a roll of paper by pressing the header against the end of the roll with a header plate, the improvement wherein the header heat plate is formed in a plurality of header face plate sections mounted together edge to edge on a backing plate, the sections being individually changeable such that the entire header heat plate need not be replaced when one section becomes damaged or wears out, the header heat plate having a core recess therein that accommodates a roll core or core plug that extends beyond the end of the paper in the roll, such that the header plate can be pressed against the paper while the core or core plug extends into the core recess in the header heat plate, the core recess being elongated in a vertical direction so as to accommodate the cores of paper rolls of different diameters.

8. A header heat plate for a paper roll wrapping machine wherein the header heat plate comprises:

a face plate comprising a plurality of separate face plate sections angularly spaced about a common axis, the face plate sections being formed of molded metal and including electrical heating elements molded integrally therein, the face plate sections having exterior electrical terminals to connect the heating elements to a power supply, each face plate section including a plurality of vacuum holes therethrough for drawing a vacuum at the surface of the face plate;

a layer of insulation behind each section of the face plate; and a common backing plate positioned behind the face plates and insulation, the face plate sections and insulation being bolted to the backing plate, the header heat plate assembly being attached to a header plate mount for the roll wrapping machine, the header plate mount having vacuum means for drawing a vacuum through vacuum holes formed through the back plate and insulation which are in communication with the vacuum holes in the face plate, the mount being axially movable to press the header heat plates inwardly against the ends of a roll of paper placed between a pair of opposed header plates and header plate mounts, the header heat plates retaining roll headers thereto by vacuum and heating and pressing the roll headers against the ends of the paper rolls, the roll headers having heat sensitive adhesive thereon that causes the roll headers to stick to the ends of the rolls when heated and pressed on the rolls by the header heat plates.

* * * * *